US006056617A

United States Patent [19]

Boyle

[11] Patent Number: 6,056,617

[45] Date of Patent: May 2, 2000

[54] SIDEWISE CHANNELED PROJECTILE FOR SIDEWISE ADVANCE DURING ROTATION AROUND ITS LENGTH

[76] Inventor: Matthew John Boyle, 2519 Grove Ave. #1, Richmond, Va. 23220

[21] Appl. No.: 09/169,821

[22] Filed: Oct. 9, 1998

[51] Int. Cl.[7] ..... A63H 27/00

[52] U.S. Cl. ..... 446/62; 244/12.6

[58] Field of Search ..... 446/34, 62, 63, 446/861, 67; 244/12.6, 16, 153 A, 39, 218

[56] References Cited

U.S. PATENT DOCUMENTS

| | | | |
|---|---|---|---|
| 927,815 | 7/1909 | Ruppin | 446/67 |
| 1,353,147 | 9/1920 | Converse | 446/62 |
| 2,476,482 | 7/1949 | Custer | 244/12.6 |
| 3,107,888 | 10/1963 | Finn | 244/153 A X |
| 3,123,321 | 3/1964 | Custer | 244/12.6 |
| 3,559,331 | 2/1971 | Eller | 446/34 |
| 3,691,674 | 9/1972 | Thompson | 446/34 |
| 4,280,673 | 7/1981 | Brzack | 446/62 X |
| 4,452,007 | 6/1984 | Martin . | |
| 4,596,367 | 6/1986 | Wittwer | 244/39 |
| 4,605,183 | 8/1986 | Gabriel | 446/62 X |
| 4,861,304 | 8/1989 | Toews . | |
| 5,173,069 | 12/1992 | Litos . | |

FOREIGN PATENT DOCUMENTS

| | | | |
|---|---|---|---|
| 387923 | 2/1933 | United Kingdom | 446/34 |

*Primary Examiner*—D Neal Muir

[57] ABSTRACT

A light-weight yet sufficiently dense object made of reasonably rigid material for throwing and catching, having an elongated main body section (12) dividing congruent angled sections **(20*a* & 20*b*) on either side. Each angled section containing a plurality of angles, and both section being mirror images of each other. The object (15)** being of suitable size so as to be thrown and caught easily by an average human.

2 Claims, 3 Drawing Sheets

SIDEWISE CHANNELED PROJECTILE FOR SIDEWISE ADVANCE DURING ROTATION AROUND ITS LENGTH

BACKGROUND—FIELD OF INVENTION

This invention relates to an object to be thrown and caught, specifically an apparatus having a specified middle section divided evenly by two angled sections, to be thrown on a longitudinal axis along an essentially vertical arc.

BACKGROUND—DESCRIPTION OF PRIOR ART

In researching the invention, a few similar structures were found, all of which seemed to lack stamina and stability.

The wing designs on these items were all essentially flat, which gives very little control or stability during flight. Without any balance or resistance, the flight path of the object would be erratic and uncontrollable. Without any control, it would be difficult for the object to be caught, thus making it difficult to successfully throw the object between two people.

And, while the flat design would seem to allow for less wind resistance at the start, the lack of airlift would seem to cause the objects to lose velocity quickly.

Also, the small size of the objects found points to other problems. First of all, the small and frail designs of the objects would make them not very durable and they could be easily broken upon landing. They would also seem to be susceptible to the slightest wind or air current, which would further upset their flight path and accuracy. Without sufficient size and weight, the objects are going, to be tossed around by the air, as well as suffer shortened flights, due to lack of momentum.

The lack of control is further exhibited by toys which are designed to fly on a spiral pivotal axis, rather than a horizontal axis. These objects cannot be aimed at all, but rather let to fly in a random path until they lose momentum and come spiraling downward.

OBJECTS AND ADVANTAGES

Accordingly, several objects and advantages of my invention are:

(a) to provide, using its angled airfoil components, superior stability and control and the ability to be guided when thrown;

(b) to provide a regulated and controlled flight path using the balance of air resistance provided by the angled sections;

(c) to provide longevity of flight, by use of the angled airfoils, the shape and design of these airfoils providing consistent lift for the structure as it sails, so as to increase the time in air;

(d) to provide sufficient weight and size to promote thrust so as to sustain air time.

While this structure, as it conforms to these parameters, provides for an essentially controlled and long flight, the object should be made of lightweight, yet durable material, to help increase the efficiency of its performance.

DESCRIPTION OF PREFERRED EMBODIMENT

Figure 1:
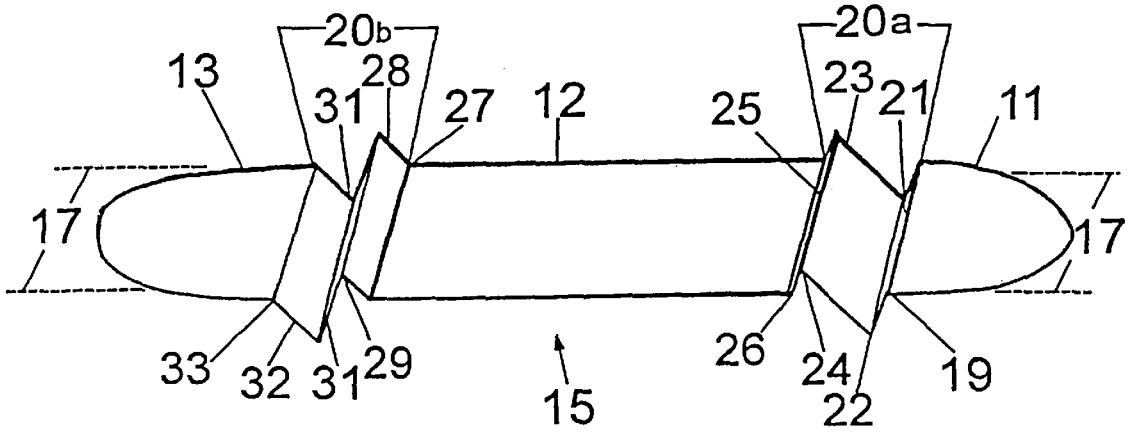
FIG. 1 is a view of the invention from an approximately 45 degree angle.

Referring to the drawings in describing the invention 15, which contains a long main body section 12, which is essentially interrupted at both ends by angled sections 20*a* and 20*b*, which each contain angles of varying degree, height, and depth, and are mirror images of one another.

In the drawing contained of the preferred embodiment of the invention (FIG. 1), referring to the first angled section 20*a*. Starting from the end section 11, of the main body 12, both of which exist on a straight plane 17, along with the last portion 13 of the main body 12; the first angled section 21, turns at approximately a 50 degree angle 19, and extends approximately one inch along section 21, whereupon turning at an approximately 80 degree angle 22, in the opposite direction of the first angle 19, and extending approximately two inches along the second section 23, whereupon turning at another approximately 80 degree angle 24, in the opposite direction as the last angle 22, and extending approximately one inch along the third section 25, whereupon turning at an approximately 50 degree angle 26, and returning to the original plane 17, whereupon extending along the main body section 12 for approximately 11 inches, whereupon turning at approximately a 50 degree angle 27, and extending approximately one inch along section 28, whereupon turning at approximately an 80 degree angle 29 in the opposite direction as the previous angle 27, and extending in such a direction for approximately two inches along section 30, whereupon turning at approximately an 80 degree angle 31, and extending along a plane for approximately one inch along section 32, whereupon turning at approximately a 50 degree angle 33, so as to return to the original plane 17, in line with the main body 12, and the opposite end section 11.

All angles 19, 22, 24, 26, 27, 29, 31, and 33 contained within the structure 15 may vary in degree, so as to maximize efficiency.

Accordingly, all angled sections 21, 23, 25, 28, 30, and 32 contained in the sections 20*a* and 20*b*, as described in the illustration FIG. 1 can be of varying length, so as to maximize efficiency.

Further, the angles and angled sections can vary in number, length and degree, so as to maximize efficiency.

Angled sections 20*a*. and 20*b*., being mirror images of each other, and lying equidistant from the center of the main body 12, wherein the angle 26 within angled section 20*a* that lies closest to the center of the main body 12 would be of equal degree and would be positioned in equal distance from the center of the main body 12, as the angle 27, within the angled section 20*b*.

All succeeding angles and wing sections leading out from the center of the main body 12, would also be the same in mirror image. The first section 21 of angled section 20*a* being the same length as the first section 31 of angled section 20*b*; the second section 23, of angled section 20*a* being the same length as the second section 30, of the angled section 20*b*; the third section 25, of angled section 20*a*, being the same length as the third section 28, of the angled section 20*b*.

Further, angle 19 would be the same as angle 33, angle 22 would be the same as angle 31, and angle 24 would be the same as angle 29.

Figure 2:
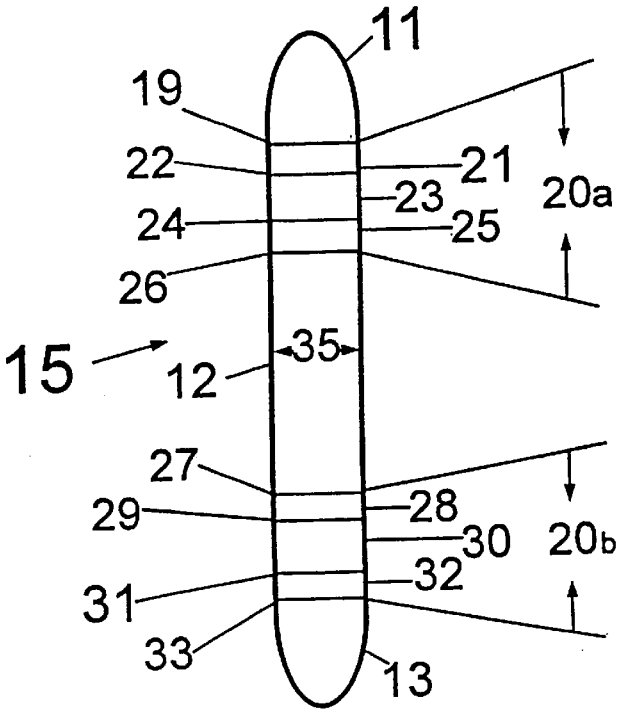
FIG. 2 is a front vertical view of the invention.
Figure 3:
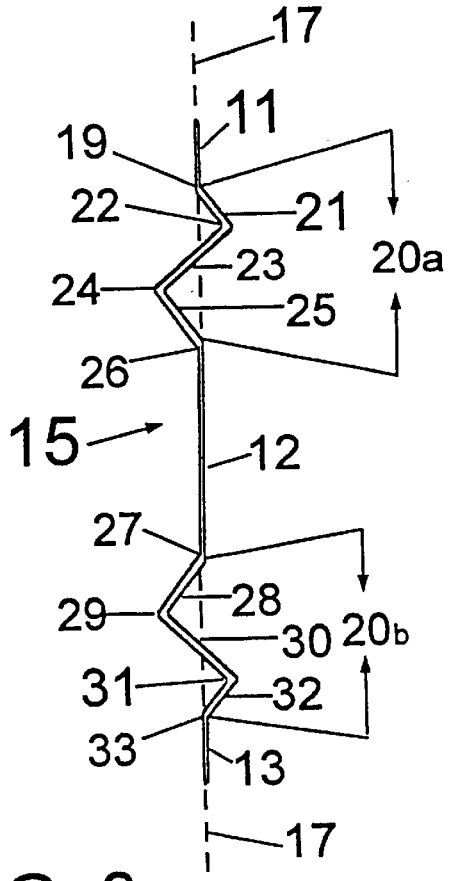
FIG. 3 is a side vertical view of the invention.
Figure 4:
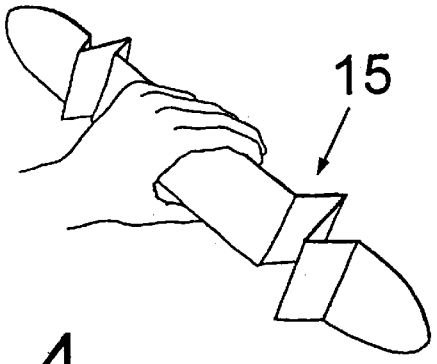
FIG. 4 is a view of how a person might grip the invention.
Figure 5:
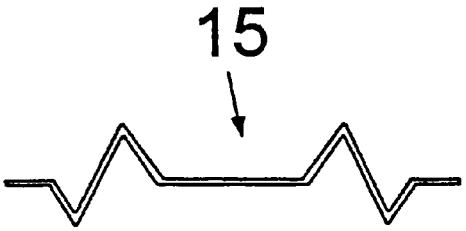
FIG. 5 is a side horizontal view of the invention.
Figure 6:
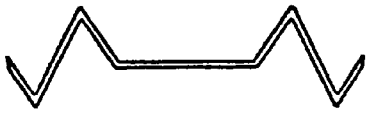
FIGS. 6–8 are side horizontal views of three other possible designs of the invention.
Figure 7:
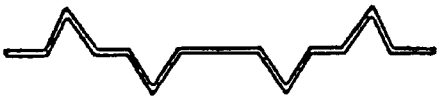
Figure 8:
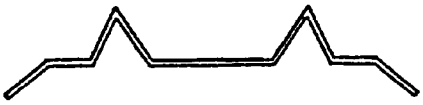

Referring to the end sections 11 and 13, as shown in FIG. 2, these sections would preferably be constructed so as to taper to rounded edges, which would decrease wind resistance and maximize flight time. The angle at which these sections 11 and 13 taper can vary but would be essentially identical and would be constructed to specifications to which the optimal flight time would be achieved.

The invention 15, would preferably be constructed of lightweight material, so as to minimize drag on the invention 15, and maximize flight time. The length of the main body 12 and the end sections 11 and 13, would vary in length and would adhere to specifications that would maximize efficiency in flight time and ease of throwing and catching the toy, in accordance to the invention 15.

Referring to the recommended embodiment of the invention, the width 35, of the main body 12 as illustrated in FIG. 2, would vary, depending on constructional design, but would most likely be between three and four inches wide, depending on what width would provide the most ease for throwing and catching.

Figure 9:
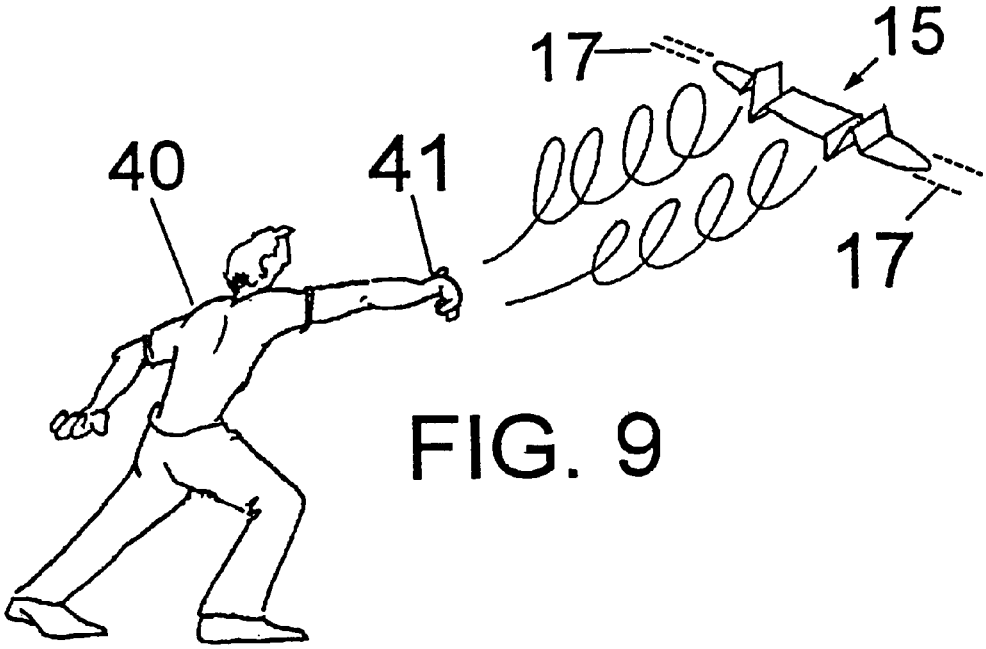
FIG. 9 shows a person throwing the invention in an overhand position in an essentially upward path.

Referring to the recommended use of the invention 15, as illustrated in FIG. 9, the main body 12, is gripped in one hand 41, and thrown so as to cause the invention 15 to travel forward in a direction away from the thrower 40, and travel on a upward path, while rotating on a reverse rotation along a horizontal plane 17.

SUMMARY, RAMIFICATIONS, AND SCOPE

As understood from the descriptions contained herein, the reader will see that the angled section single wing throwing toy of this invention can be used to throw and catch in a successful manner, and can be greatly controlled by use of the balance provided by the symmetrically mirrored angled sections.

In addition, the toy's angled sections also provide air lift and stability during flight.

The size and weight of the toy also aid in flight time, providing thrust and momentum.

Although the description above contains several specifications, these should not be construed as limiting the scope of the invention but as merely providing illustrations of some of the presently preferred embodiments of this invention. For example, the toy can have varied numbers of angles contained within the angled sections. Further, the end sections could have varied shapes other than rounded, such as oval, squared, or decorative, provided the design does not greatly decrease the efficiency of the toy.

Thus the scope of the invention should be determined by the appended claims and their legal equivalents, rather than by the examples given.

I claim:

1. In apparatus for flight through air comprising a central component between a pair of outer components which assist flight and extend outwardly from the central component to their respective outer ends, the central component being actuatable to rotate the whole apparatus around a longitudinal axis which extends between said outer ends and to launch the rotating apparatus sidewise in a direction at substantially right angles to said longitudinal axis, most of the lengths of the outer components between said ends being in a common plane passing through the central and outer components, the improvement in which each of said outer components comprises inner and outer parts lying in said plane and separated by a space between them in said plane, and comprises a series of panels which integrally connect said separated inner and outer parts, said panels each having along its periphery a pair of opposite sides which are substantially parallel to each other and to said opposite sides of the other panels, the first of said panels having one of its said opposite sides in said plane next to and integral with said inner part where it ends at said space, said one side being at substantially right angles to the direction of outward extension of said inner component, and the other opposite side of the first panel being spaced away from one face of said plane; the second of said panels having one of its said opposite sides lying in said plane next to and integral with said outer part where it ends at said separating space, and the other of its said opposite sides is spaced away from the face of said plane opposite to its said one face so that said plane is between said sides of the first and second panels which are spaced away from said plane; and the third of said panels has its said pair of opposite sides integrally joined to the respective sides of the first and second panels which are spaced away from opposite faces of said plane, and between its said opposite sides said third panel extends through said plane and said separating space.

2. In apparatus for flight through air comprising a central component between a pair of outer components which assist flight and extend outwardly from the central component to their respective outer ends, the central component being actuatable to rotate the whole apparatus around a longitudinal axis which extends between said outer ends and to launch the rotating apparatus sidewise in a direction at substantially right angles to said longitudinal axis, most of the lengths of the outer components between said ends being in a common plane passing through the central and outer components, the improvement in which each of said outer components comprises a part lying in said plane and a series of panels which are integral with said part and extend outwardly from the outer end of said part, each of said panels having along its periphery a pair of opposite sides which are substantially parallel to each other and to said opposite sides of the other said panels, the first of said panels each having one of its said opposite sides in said plane next to and integral with the outer end of said part, said one side being at substantially right angles to the direction of outward extension of said said part, and the other of said opposite sides of the first panel being spaced away from one face of said plane where the plane projects outwardly beyond said outer end of said part; the second of said panels having one of its said opposite sides spaced away from the face of said plane opposite to its said one face so that the plane extends between said sides of the first and second panels which are spaced away from said plane, the other of said opposite sides of the second panel lying substantially in said plane at the outer end of said series of panels; and the third of said panels having its said pair of opposite sides integrally joined to the respective sides of the first and second panels which are spaced away from said opposite faces of said plane, the third panel also extending through said plane between said opposite sides of the third panel.

* * * * *